United States Patent [19]

Jackson et al.

[11] 4,423,402

[45] Dec. 27, 1983

[54] TEMPERATURE SENSITIVE CAPSULES

[75] Inventors: Thomas M. Jackson; Robert J. Hodges, both of Hertfordshire, England

[73] Assignee: ITT Industries, Inc., New York, N.Y.

[21] Appl. No.: 371,674

[22] Filed: Apr. 26, 1982

[30] Foreign Application Priority Data

Jul. 21, 1981 [GB] United Kingdom ..... 8122394

[51] Int. Cl.[3] ..... H01H 37/36

[52] U.S. Cl. ..... 337/323; 337/326

[58] Field of Search ..... 337/306, 309, 311, 312, 337/314, 315, 323, 326, 327

[56] References Cited

U.S. PATENT DOCUMENTS

| | | | |
|---|---|---|---|
| 2,840,669 | 6/1958 | Russell | 337/326 |
| 3,609,272 | 9/1971 | Heaps | 337/323 X |
| 3,636,288 | 1/1972 | Russell | 337/323 X |

*Primary Examiner*—George Harris

*Attorney, Agent, or Firm*—James B. Raden; William J. Michals

[57] ABSTRACT

A capsule for use as a temperature responsive element in a temperature sensitive electrical switch. The capsule is provided in a transistor mounting can configuration to facilitate printed circuit board mounting. The capsule contains a fluid and a concave disc. At a predetermined temperature, the disc snaps-over into a convex configuration. Movement of the disc is detected to provide an output signal which is temperature responsive.

10 Claims, 6 Drawing Figures

TEMPERATURE SENSITIVE CAPSULES

BACKGROUND OF THE INVENTION

This invention relates to temperature sensitive capsules, particularly but not exclusively for use as the temperature responsive elements of temperature sensitive electrical switches, that is switches which respond when the temperature to which they are subjected reaches or exceeds a predetermined level.

Our British Patent Specifications Nos. 1509772 (T. M. Jackson-R. J. Hodges 51-25) and 1571754 (T. M. Jackson-R. J. Hodges 58-34) describe such switches. The switches essentially comprise a capsule, closed at one end by a domed or bowed disc having a flip-over characteristic, and containing a quantity of suitable gas or liquid which, on expanding due to a temperature rise, causes the disk to deflect and operate a set of electrical contacts.

In order to improve the performance or characteristics of these known basic switches or other similar switches employing such capsules various modifications to the capsule thereof are now proposed.

According to one aspect of the present invention there is provided a capsule, for use as a temperature responsive element, comprising a sealed enclosure containing a liquid or gas, one wall of the enclosure being a bowed disc, wherein when the temperature to which the capsule is subjected passes through a predetermined value the vapour pressure within the enclosure changes in such a way as to cause the bowed disc to change from a concave state to a convex state, or vice versa, and wherein the disc is manufactured from precipitation hardened stainless steel or precipitation hardened beryllium copper.

According to another aspect of the present invention there is provided a capsule, for use as a temperature responsive element, comprising a sealed enclosure containing a liquid, one wall of the enclosure being a bowed disc, wherein when the temperature to which the capsule is subjected passes through a predetermined value the vapour pressure within the enclosure changes in such a way as to cause the bowed disc to change from a concave state to a convex state, or vice versa, wherein the capsule is filled with a minimum amount of the liquid such that the capsule operates normally in a logarithmic mode up to the limit of saturated vapour but such that in the event of overtemperature the filling behaves like a gas and obeys gas laws whereby to reduce the rate of pressure increase with temperature within the capsule.

According to a further aspect of the present invention there is provided a method of adjusting the operate temperature of a capsule, for use as a temperature responsive element, to a predetermined value, which capsule comprises a sealed enclosure containing a liquid or gas and such that when the temperature to which the capsule is subjected passes through a certain value, the operate temperature, the vapour pressure within the enclosure changes in such a way as to cause a bowed wall forming one wall of the enclosure to change from a concave state to a convex state, which method comprises reducing the internal volume of the enclosure, by permanently deforming another wall of the enclosure, to a volume value at which the bowed disc will change state when the enclosure is heated at the predetermined value.

According to yet another aspect of the present invention there is provided a method of adjusting the release temperature of a capsule, for use as a temperature responsive element, to a predetermined value, which capsule comprises a sealed enclosure containing a liquid or gas and such that when the temperature the capsule is subjected to passes through a certain value, the release temperature, the vapour pressure within the enclosure changes in such a way as to cause a bowed disc forming one wall of the enclosure to change from a convex to a concave state, the disc being connected to a cylindrical can member, closed at one end and forming the remaining walls of the enclosure, at the end opposite the one end by means of a flange initially extending in a first direction radially outwards with respect to the axis of the cylinder, which method comprises permanently distorting the flange to extend at such an angle to the first direction whereby the disc is biased to change between the convex and concave states when the capsule is heated at the predetermined release temperature value.

Embodiments of the invention will now be described with reference to the accompanying drawings, in which.

Figure 1:
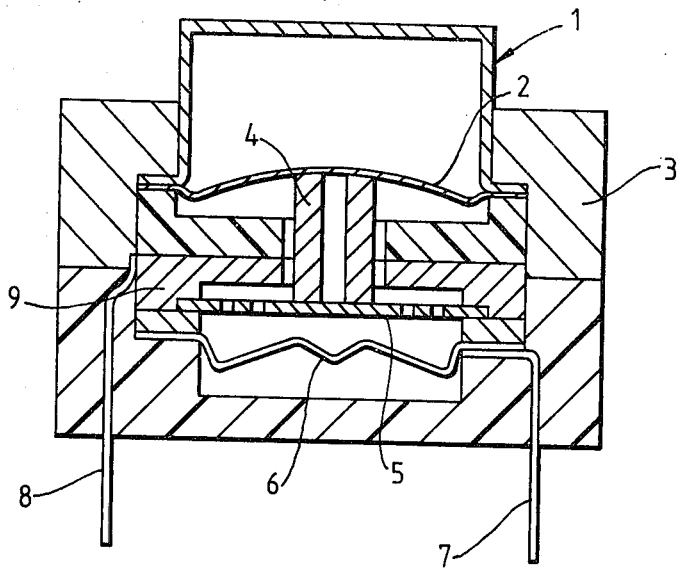
Fig. 1. PRIOR ART
FIG. 1 shows a section through one known temperature sensitive electrical switch which is illustrated somewhat schematically.

The known switch shown in section in FIG. 1 has a cylindrical capsule 1 containing a volatile liquid such as dichloro-difluoro methane ($C\ Cl_2F_2$), sold as FREON (Registered Trade Mark), the lower side of the capsule being a thin metallic disc 2 which is bowed inwardly. This capsule is mounted in a suitable electrically insulating material member 3. The disc 2 has on its outer face a pillar 4 which is in driving relation with the centre portion of a slotted metallic disc 5. The rim of this disc is secured as shown to the structure of the switch.

Below the disc 5, but out of contact therewith, there a further metallic disc 6, such as a Belleville washer, whose rim is secured to the structure of the switch. There are two electrical contacts having pins 7 and 8 for connection to an electrical unit. The first contact is formed by the disc 5, which is electrically connected to the pin 8 via portion 9, while the second contact is formed by the disc 6, which is electrically connected to the pin 7.

When the temperature reaches the level to which the switch is set, vapour pressure in the capsule flips the bowed disc from its concave to its convex state, which causes the pillar 4 to drive the central portion of the slotted disc 5 into engagement with the disc 6, thus completing the electrical circuit.

Figure 2:
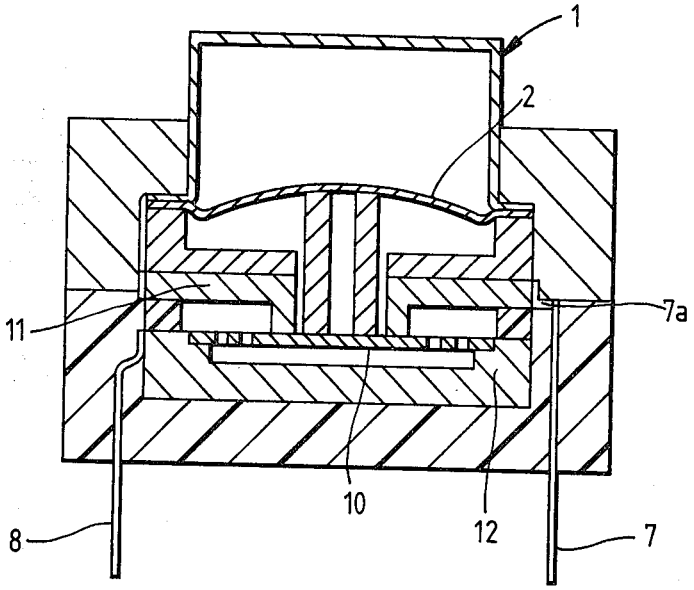
Fig. 2. PRIOR ART
FIG. 2 shows a similar section through a second known temperature sensitive electrical switch.

The switch shown in section in FIG. 2 is similar in many respects to that of FIG. 1, but provides a break contact. A slotted disc 10 which is driven by the capsule 1 is indirectly connected to terminal pin 8 via metallic support member 12. However, its centre portion makes contact with member 11 which is connected to pin 7 by being soldered thereto at 7*a*. Hence it will be seen the contacts of the switch are normally closed.

When the temperature reaches the level at which the switch is intended to operate, the disc 2 drives the disc 10 down, so that the connection between the members 10 and 11 is broken.

In both of the switches described above, when the temperature falls below the preset level, condensation of the vapour causes the bowed disc 2 to revert to its condition shown in the drawings.

Various other switches or devices employing such a capsule 1 are possible. A change-over switch can be produced by effectively combining FIGS. 1 and 2. A switch can be rendered adjustable by means of a heater arranged in the capsule. A spring may be arranged in the capsule to assist in defining the temperature at which the switch responds.

The basic structure of the capsule is welded together. The capsule filling was described above as C $Cl_2F_2$, but this is only one of a number of fluorinated halocarbons, or other liquids or gases, from which the capsule filling is selected. By a suitable choice of the filling, the switch's operating temperature can be chosen to lie anywhere in a wide temperature range, e.g. +30° C. to +200° C. although the theoretical limits determined by the available fluoride are around −200° C. to +200° C. The characteristics on which operation depends are the curves which relate temperature and vapour pressure, and these curves, unlike those for the gas laws, have a logarithmic characteristic.

Various modifications to the known capsules described above are now proposed, which modifications serve to improve the performance of switches or other devices incorporating the temperature sensitive capsules.

The bowed disc 2 which is designed to flip when the pressure acting on it reaches a given value may be manufactured from any material which exhibits high elasticity and sufficient elongation to allow it to be formed into the required shape. Three materials which have conventionally been used are beryllium copper, phosphor bronze and hard rolled stainless steel. Of these three hard rolled stainless steel was preferred because of its low cost relative to the copper based alternatives. Unfortunately discs manufactured from hard rolled stainless steel suffer from stress relaxation when exposed to high temperature which results in temperature drift in the final switch.

To overcome this problem we have now found it to be advantageous to manufacture the discs 2 from precipitation hardened stainless steel, such as Armco 17-7 PH. The discs are formed from this material in an annealed state and are, therefore, stress free. After forming, the discs are hardened by heat treatment to produce the spring-like properties required. Typically this heat treatment comprises the following steps, namely:

(a) heat to 1400° F.±25° F. and hold at this temperature for 90 minutes;
(b) cool to 60° F.+0° F. (or −10° F.) within one hour and hold for one hour;
(c) heat to 1050° F.±10° F. and hold for 90 minutes, and
(d) air cool to room temperature. (Suppliers recommended method).

Discs thus produced have good stability up to about 200° C. Tests have shown that whereas a conventional thermal switch employed on a fan heater showed considerable changes in operate and release temperatures when subjected to 100° C. (equivalent to a 20° C. overtemperature) for 48 hours, the corresponding change for switches employing capsules with precipitation hardened stainless steel discs was negligible, showing that such material provides improved high temperature stability. Alternatively precipitation hardened beryllium copper may be employed for the discs.

It is desirable that switches or other devices operated by vapour pressure should be protected against overtemperature. This may be achieved simply by ensuring that only a minimum volume of liquid is filled into the capsule. Thus the capsule will operate normally up to the limits of saturated vapour in a logarithmic mode, however in the event of overtemperature the operating mode extends beyond the saturated vapour limit and the filling behaves like a gas and obeys the gas laws. The rate of pressure increase with temperature within the capsule is then reduced, thereby protecting the capsule. Typically a capsule based on a TO3 transistor can of 7 mm height will be filled with only 30$\mu$ liters of liquid and will be able to withstand an overtemperature of 50° C.

In some applications of temperature sensitive electrical switches or other devices it is desirable that the operate temperature of the switch or device has a closer tolerance than the ±3° C. tolerance achieved with standard manufacturing techniques. Thus it is desirable to be able to adjust the operate temperature correspondingly during capsule manufacture. This can be achieved by reducing the internal volume of the capsule by deforming the can thereof. Adjustment of the operate temperature can thus be performed completely automatically.

Figure 3:
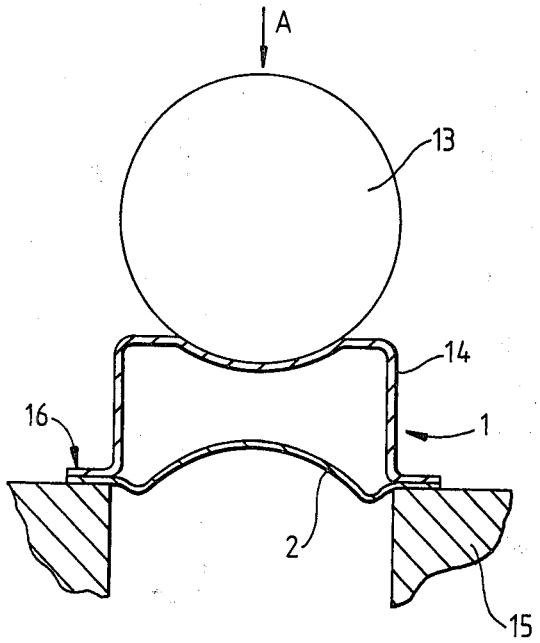
FIG. 3 shows, schematically, capsule crushing according to one aspect of the present invention.

One method of volume reduction is illustrated in FIG. 3 and simply comprises driving a ball 13 into the end face of a can portion 14 of a capsule 1. The capsule 1 is held in a jig, illustrated schematically at 15, maintained at the desired operate temperature. The ball 13 is then brought slowly down (in direction A) onto the end face of the can 14 to deform it, until the capsule is just operated, that is the disc 2 flips over. This method is particularly suitable for use in automatic adjustment of the operate temperature of capsules. An automatic setup would basically comprise a heated jig, means to position each of a plurality of unadjusted capsules successively on the jig, can deformation means urged slowly towards the can until the disc flips over from the concave to the convex state, the action of flipping over can be employed to prevent further movement of the deformation means towards the can by actuating a switch, and means to remove adjusted capsules from the jig. With such can crushing adjustment the operate temperature can be adjusted to within 1° C. The maximum range of adjustment on a typical TO3 based capsule is of the order of 9° C.

Figure 5A:
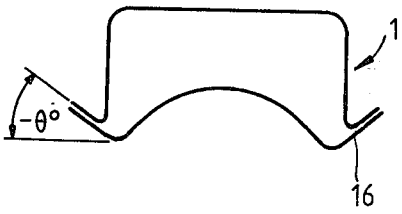
FIGS. 5*a* and 5*b* show, schematically, two capsule flange adjustment possibilities.
Figure 5B:
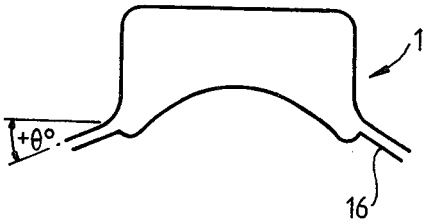

In other applications of temperature sensitive electrical switches or other devices a closely controlled release temperature is required. We have found that it is possible to adjust the release temperature without influencing the operate temperature to any marked degree. This is achieved by deliberately distorting the flange 16 (FIG. 3) of the capsule 1, so as to bias the flip action of the bowed disc either inwards or outwards with respect to the can 14 of the capsule. As shown in FIGS. 5*a* and *b*, either a negative or positive distortion angle $\theta$ can be used. When a positive angle $\theta$ is used it is possible to reduce the hysteresis of the capsule. Typically $\theta$ is of the order of 10 degrees although anywhere within 5° to 20° could be used.

Figure 4:
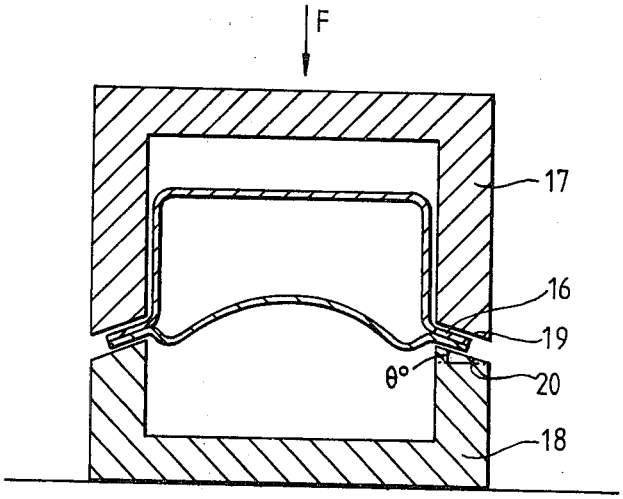
FIG. 4 shows, schematically, capsule flange adjustment according to another aspect of the present invention.

One jig for adjusting the capsule flange is shown in FIG. 4. This simply comprises two hollow bodies 17 and 18 between a capsule 1 can be arranged. The opposing parallel surfaces 19 and 20 are arranged at a suitable angle $\theta$ to the horizontal whereby when the bodies are gradually brought together by an applied force F the flange 16 is correspondingly gradually permanently deformed to a maximum angle $\theta$. The capsule can have its flange deformed in the negative direction by arranging the capsule in the jig the other way up, or placing body 18 on top of body 17 and applying the force F to body 18 rather than 17.

As in the case of adjusting the operate temperature of a capsule, adjusting the release temperature of a capsule may be achieved by progressively deforming the flange 16, whilst heating the capsule at the required release temperature, until the disc flips over from the convex to the concave state. Thus flange adjustment can also be performed in an automatic manner.

We claim:

1. A capsule, for use as a temperature responsive element, comprising a sealed enclosure containing a liquid or gas, one wall of the enclosure being a bowed disc, wherein when the temperature to which the capsule is subjected passes through a predetermined value the vapour pressure within the enclosure changes in such a way as to cause the bowed disc to change from a concave state to a convex state, or vice versa, and wherein the disc is manufactured from precipitation hardened stainless steel or precipitation hardened beryllium copper.

2. A capsule as claimed in claim 1, wherein the precipitation hardened stainless steel comprises Armco 17-7 PH.

3. A capsule as claimed in claim 1 or claim 2, wherein the disc is formed from precipitation hardened stainless steel in an annealed state, and wherein the formed disc is subsequently hardened by heat treatment.

4. A capsule, for use as a temperature responsive element, comprising a sealed enclosure containing a liquid, one wall of the enclosure being a bowed disc, wherein when the temperature to which the capsule is subjected passes through a predetermined value the vapour pressure within the enclosure changes in such a way as to cause the bowed disc to change from a concave state to a convex state, or vice versa, wherein the capsule is filled with a minimum amount of the liquid such that the capsule operates normally in a logarithmic mode up to the limit of saturated vapour but such that in the event of overtemperature the filling behaves like a gas and obeys gas laws whereby to reduce the rate of pressure increase with temperature within the capsule.

5. A method of adjusting the operate temperature of a capsule, for use as a temperature responsive element, to a predetermined value, which capsule comprises a sealed enclosure containing a liquid or gas and such that when the temperature to which the capsule is subjected passes through a certain value, the operate temperature, the vapour pressure within the enclosure changes in such a way as to cause a bowed wall forming one wall of the enclosure to change from a concave state to a convex state, which method comprises reducing the internal volume of the enclosure, by permanently deforming another wall of the enclosure, to a volume value at which the bowed disc will change state when the enclosure is heated at the predetermined value.

6. A method as claimed in claim 5, wherein the internal volume is progressively reduced by progressively deforming the other wall, whilst heating the capsule at the predetermined operate temperature value, until the bowed disc changes from the concave to the convex state.

7. A method as claimed in claim 6, wherein the progressive deformation is achieved by progressively driving a ball into a wall of the enclosure opposite to the bowed disc.

8. A method of adjusting the release temperature of a capsule, for use as a temperature responsive element, to a predetermined value, which capsule comprises a sealed enclosure containing a liquid or gas and such that when the temperature the capsule is subjected to passes through a certain value, the release temperature, the vapour pressure within the enclosure changes in such a way as to cause a bowed disc forming one wall of the enclosure to change from a convex to a concave state, the disc being connected to a cylindrical can member, closed at one end and forming the remaining walls of the enclosure, at the end opposite the one end by means of a flange initially extending in a first direction radially outwards with respect to the axis of the cylinder, which method comprises permanently distorting the flange to extend at such an angle to the first direction whereby the disc is biased to change between the convex and concave states when the capsule is heated at the predetermined release temperature value.

9. A method as claimed in claim 8, wherein the flange is progressively permanently distorted, whilst heating the capsule at the predetermined release temperature value, until the bowed disc changes from the convex state to the concave state.

10. A method as claimed in claim 8 or 9 wherein the flange is distorted in the direction away from the one end of the can.

* * * * *